US005388505A

United States Patent [19]

Verhart

[11] Patent Number: 5,388,505

[45] Date of Patent: Feb. 14, 1995

[54] APPARATUS FOR LOOP BINDING AN ARTICLE OR BUNDLE OF ARTICLES WITH AN ARCUATE SECTIONAL ANNULAR GUIDE AND RESTRAINER

[75] Inventor: Willem J. Verhart, Sijbekarspel, Netherlands

[73] Assignee: Hoogovens Groep BV, Ijmuiden, Netherlands

[21] Appl. No.: 32,006

[22] Filed: Mar. 16, 1993

[30] Foreign Application Priority Data

Mar. 16, 1992 [NL] Netherlands ..... 9200485

[51] Int. Cl.[6] ..... B65B 27/10; B65B 13/06

[52] U.S. Cl. ..... 100/26; 100/31; 100/32

[58] Field of Search ..... 100/7, 13, 26, 31, 32, 100/212

[56] References Cited

U.S. PATENT DOCUMENTS

| | | | |
|---|---|---|---|
| 2,492,228 | 12/1949 | Lee et al. | 100/31 X |
| 3,012,497 | 12/1961 | Fryer | 100/31 X |
| 3,234,870 | 2/1966 | Missioux | 100/26 |
| 4,714,016 | 12/1987 | Bond | 100/212 |

FOREIGN PATENT DOCUMENTS

| | | | |
|---|---|---|---|
| 33637 | 7/1908 | Austria | 100/212 |
| 0074985 | 8/1984 | European Pat. Off. . | |
| 3213994 | 11/1982 | Germany | 100/31 |
| 7208653 | 12/1973 | Netherlands . | |
| 1001385 | 8/1965 | United Kingdom . | |
| 1630983 | 2/1991 | U.S.S.R. | 100/31 |
| 1678700 | 9/1991 | U.S.S.R. | 100/31 |
| 82/03368 | 10/1982 | WIPO . | |

*Primary Examiner*—Stephen F. Gerrity
*Attorney, Agent, or Firm*—Stevens, Davis, Miller & Mosher

[57] ABSTRACT

Method and apparatus for forming a binding around an article or bundle of articles by a length of stiff wire wherein at least two and preferably three turns of the wire are made, the wire is joined at its ends and thereafter a lifting loop is made in at least one turn, for use in mechanical handling of the article or bundle. The lifting loop is formed by pulling the turn away from the article or bundle while at the same time another turn is tightened around the article or bundle.

5 Claims, 4 Drawing Sheets

APPARATUS FOR LOOP BINDING AN ARTICLE OR BUNDLE OF ARTICLES WITH AN ARCUATE SECTIONAL ANNULAR GUIDE AND RESTRAINER

BACKGROUND OF THE INVENTION

1. Field of the Invention

This invention relates to a method of forming a binding around at least one article by means of a length of stiff wire, to an apparatus for binding at least one article by such a method and to an article or articles bound by the method. Where a plurality of articles is bound by the method, they are referred to in this description as a bundle of articles. Typically the articles bound are elongate, e.g. are metal rods or strips.

2. Description of the Prior Art

EP-A-74985 describes a method using a piece of stiff wire for forming a binding around a bundle of rod material, in which the piece of wire is led around the bundle once and a join is made between the head and tail of the piece of wire. FIG. 1 of the present drawings illustrates the resultant bound bundle. The apparatus for binding comprises an annular structure provided with a channel for guiding the wire, which channel is U-shaped in cross-section with the open side of the U facing the bundle inserted for binding by the annular structure.

By this method and apparatus the wire is guided once around the bundle to be bound. Then, with its head held fast, the wire is pulled back so that it lies in one tight turn around the bundle, then it is knotted and cut so that a binding with one turn is created.

GB-A-1001385 illustrates a similar method and apparatus in which it is additionally suggested that the guide path for the wire in the annular guide may have more than one turn, so that two or more turns of the wire around the article being bound are made. Again the wire is pulled tight by pulling its ends, before it is knotted.

The bound bundles created by these methods consist of, for example, concrete reinforcing steel rods. In general the bundles subsequently must be transported and stored several times. In practice the bundles are handled by lifting. A problem with this is that the bundles bound in the known manner have no suitable lifting points. It has been found that the known binding cannot serve as lifting point because, when the binding is taut, a lifting hook cannot be hooked around the wire, and even if that is possible with a slightly looser binding the knot does not hold. The result is that many different means of lifting have to be available for handling and storage. Typically, along the handling route of the bundles there are chains and straps which have to be placed around the stored bundles before they can be lifted.

SUMMARY OF THE INVENTION

An object of the invention is to solve the problem described above. The invention can also achieve further advantages which are explained in the following.

According to the invention in one aspect there is provided a method of forming a binding around an article or bundle of articles by means of a length of stiff wire, comprising the steps of:

(a) placing the wire around the article(s) to form at least two turns around the article(s); and (b) joining the two ends of the wire; characterized by:

(c) pulling at least one of said turns away from the article(s) to form a lifting loop in the form of a portion of the or each pulled turn spaced from the article(s) and at the same time tightening another said turn to bind the article(s) tightly.

Preferably the turn which is tightened in step (c) includes the joining of the wire ends. In the invention the pulling of a turn or turns of the wire is laterally away from the article being bound, i.e. the wire is pulled transversely to its length direction, and this pulling is done after the joining has been made. This compares with the known methods in which the wire is pulled longitudinally to tighten it, before the joining is made. The invention makes use of the stiffness of the wire, to achieve a new effect.

Having at least two turns per binding means that two functions may be fulfilled with a binding of a bundle of articles, namely holding together the bundle and providing a lifting point for the crane hook. When lifting by one of the two turns, the second is pulled tighter around the bundle. In view of this, lifting should be by the turn without the joining. This lifting point is capable of taking greater loadings than a lifting point formed by a binding with one single turn.

Preferably in the invention, three turns are made per binding. Two of the turns may be pulled simultaneously to form lifting loops. The advantage of this is that the loading on the knot is even more reduced and the ability of the lifting point to carry loadings is further increased.

Applying the method in accordance with the invention also creates savings because it is possible to dispense with placing spacing means, such as wooden packing blocks, that are necessary in the case of bundles bound in accordance with the known method, for maintaining space beneath the bundle to allow auxiliary lifting means to be put in place.

The invention also provides an apparatus for binding an article or bundle of articles by means of stiff wire comprising:

annular guide means for guiding the wire around the article(s) to form at least two turns around the article(s); and means for joining the ends of the wire; characterized by:

pulling means insertable within at least one of said turns for forming at least one lifting loop in the form of a portion of said wire spaced from the article(s) by pulling a portion at least one of said turns away from the article(s).

Preferably the apparatus has restraining means, to hold back the article or bundle when the turn or turns of wire are pulled to create the lifting loop or loops, i.e. to hold the article or bundle against the pulling force.

In a preferred embodiment of the apparatus in accordance with the invention the annular guide is separable into at least two parts, one of which carries the pulling means. This can achieve the effect that opening the annular structure, for example by lifting up the top part, is accompanied by the pulling of one or more turns of the wire, so that the lifting loop or loops are available from the moment that the articles are bound into a bundle.

Preferably, to form an annular channel of helical shape for guiding the wire, side wall parts are attached to an annular base. The channel is thus composed of replaceable elements, so that maintenance is simplified, as is fabrication of the annular structure.

In another aspect the invention provides an article or bundle of articles bound by a length of stiff wire joined at two ends thereof and passing around said article(s) in at least two turns, at least one of said turns being deformed to provide a lifting loop in the form of a portion of said turn spaced from the article(s) and at least one other said turn of the wire being tightly engaged around said article(s).

BRIEF INTRODUCTION OF THE DRAWINGS

Embodiments of the invention will be described below by way of non-limitative example with reference to the accompanying drawings, in which.

DESCRIPTION OF THE PREFERRED EMBODIMENTS

Figure 1:
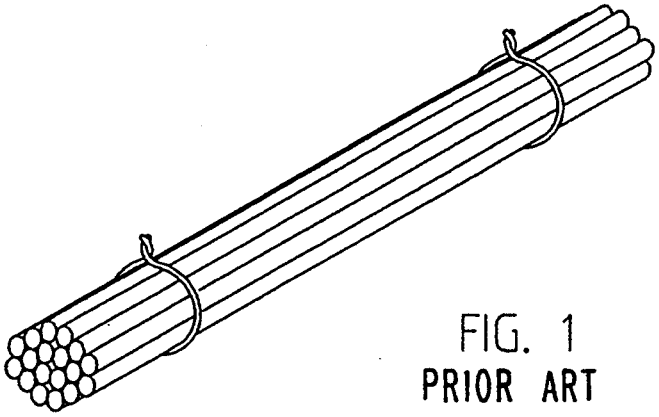
FIG. 1 PRIOR ART
FIG. 1 shows a bundle with two wire bindings of one turn in accordance with prior art, as described above.
Figure 2:
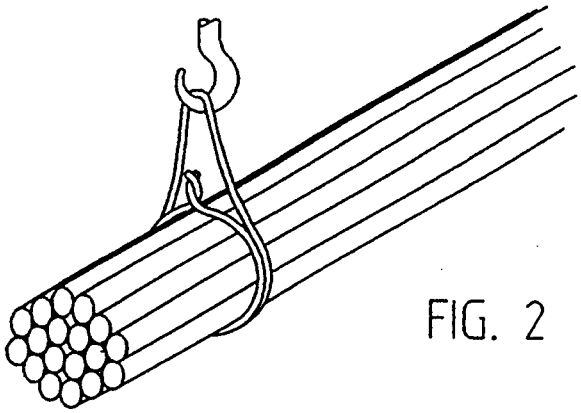
FIG. 2 shows a bundle with a binding in accordance with the invention with two turns and lifting loop.

FIG. 2 shows a bundle of steel rods with a binding of stiff wire according to the invention. The binding wire passes around the rods in two complete turns, one of which tightly engages the rods and includes the joining knot of the wire ends and the other of which has a portion standing laterally away from the bundle of rods and forming a lifting loop which can be engaged by a lifting hook, e.g. of a crane, as illustrated. Being stiff, the wire maintains the illustrated shape.

Figure 3:
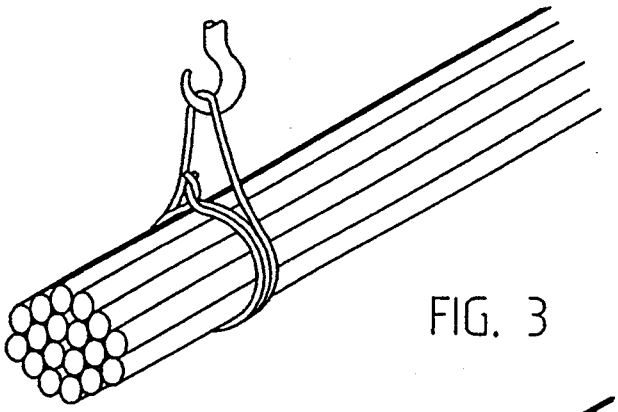
FIG. 3 shows a bundle in accordance with the invention bound by a binding with three turns, one of which is pulled into a lifting loop.

FIG. 3 shows another binding made according to the invention in which the stiff wire makes three turns around the rods. Two of the turns, including the turn with the knotted wire ends, tightly engage the rod bundle and maintain the shape of the rod bundle, while the third turn includes a lifting loop as described in relation to FIG. 2.

Figure 4:
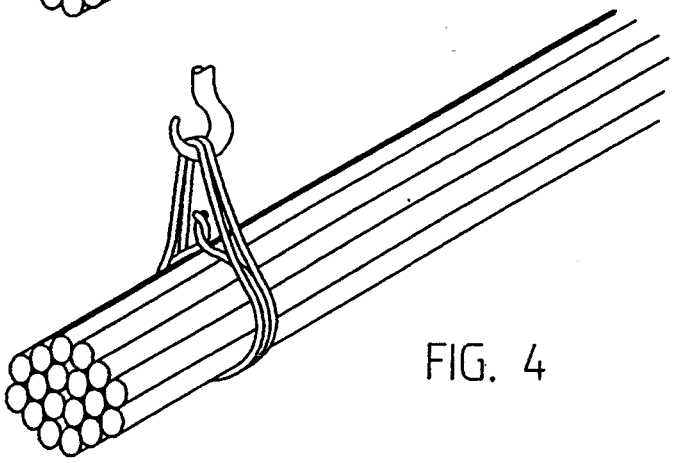
FIG. 4 shows a bundle in accordance with the invention bound by a binding with three turns, two of which are pulled into lifting loops.

In the binding of the invention shown in FIG. 4, the stiff wire makes three turns around the rod bundle, one turn being tight around the rods and including the knot, while the other turns both include a lifting loop as described. The two lifting loops are adjacent, so that they can be caught together by a lifting hook.

The method according to the invention for making the bindings of FIGS. 2 to 4 will be readily apparent. The wire is passed around the bundle with the desired number of turns. Then the knot is made at the ends of the desired wire length, which length is longer than the amount of wire needed to make tight turns only, i.e. the wire is not tight around the bundle at this stage. After the knot is made, one turn (FIGS. 2 and 3) or two turns together (FIG. 4) are pulled laterally away from the bundle to take up the slack in the wire, thereby forming a lifting loop or loops and at the same time tightening the remaining turn (FIGS. 2 and 4) or two remaining turns (FIG. 3) around the bundle. The tightened turn or turns thus serve to maintain the bundle shape. A tight, shaped bundle is thereby obtained, which in addition is easily picked up and transported by means of the lifting loop or loops. Typically, two bindings as shown are applied, along the length of the bundle of rods. The invention can be applied to single articles, and to bundles of articles of a wide variety of shapes and sizes. The articles must be able to resist the forces applied.

Figure 6:
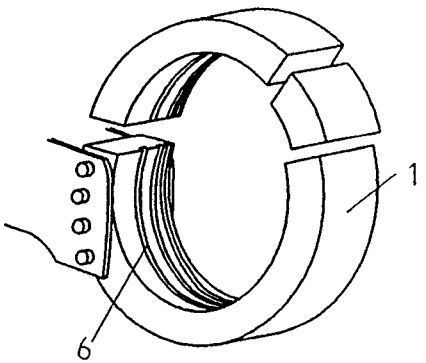
FIG. 6 shows a perspective view of the annular structure of the apparatus of FIG. 5.
Figure 5:
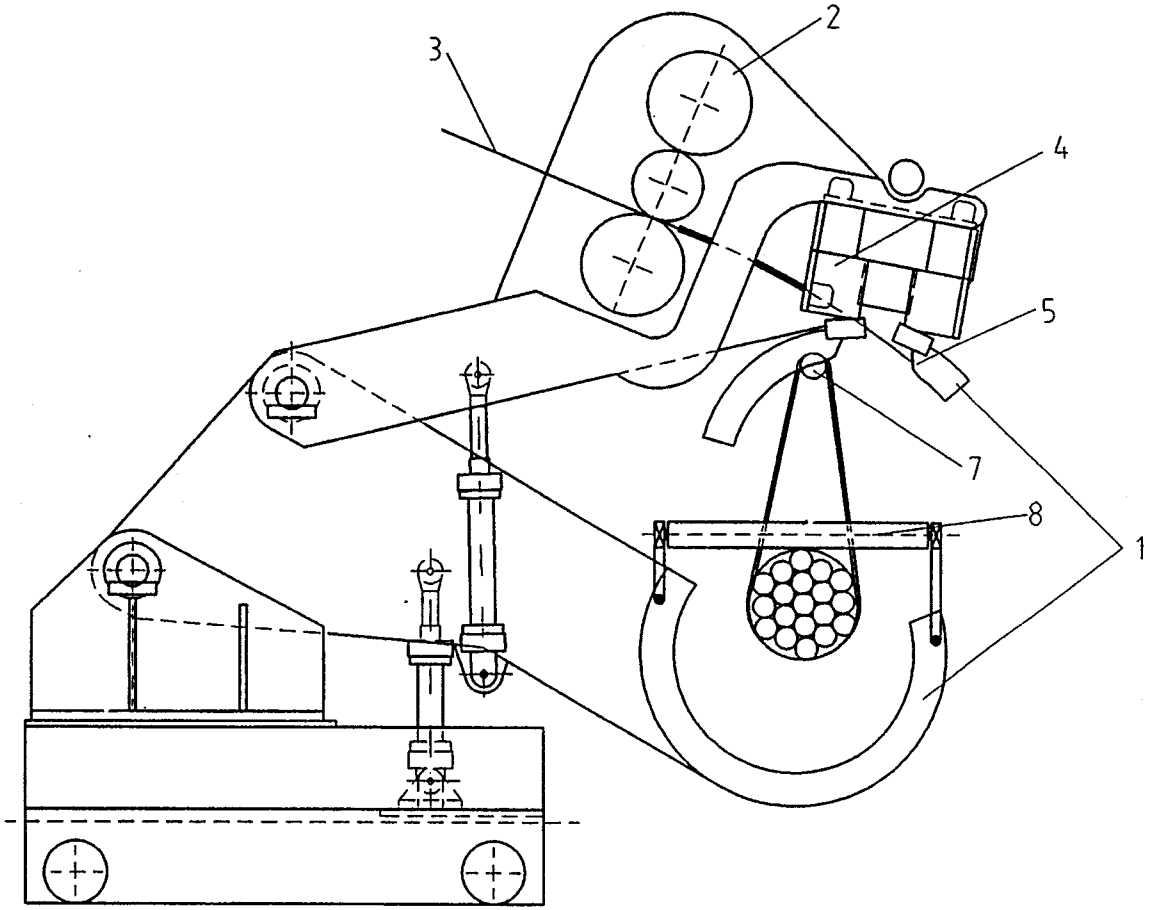
FIG. 5 shows an apparatus in accordance with the invention for binding articles or bundles in accordance with the invention.
Figure 7:
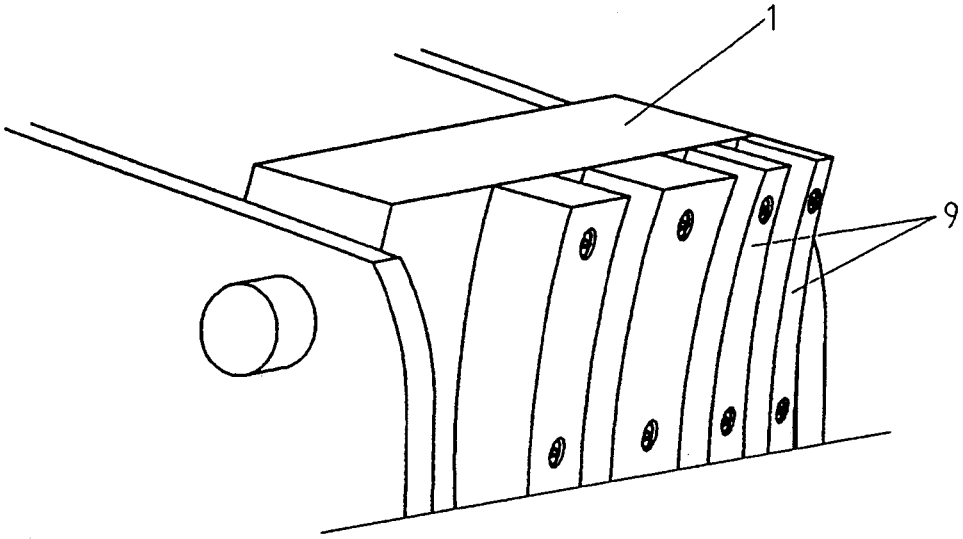
FIG. 7 shows elements which form the helical channel of the annular structure shown in FIG. 6.

In the apparatus shown in FIGS. 5 to 7, a bundle, for example of rods of concrete reinforcing steel, is shown lying in an annular structure 1 which constitutes a wire guide and, as FIGS. 5 and 6 show, is in three separable parts which can be closed together to form a ring around the rod bundle. A wire conveying device 2 conveys the wire 3, for example 7 mm outside diameter steel rod wire, via a sleeve 4 through an inlet opening 5 in the annular structure 1 now in its closed position. The inlet opening 5 allows access to a groove-shaped helical channel 6 (FIGS. 6 and 7) that guides the wire head as it is advanced. The more the wire conveying device 2 conveys wire, the more the wire following behind the head and guided by the channel 6 will be advanced and encircle the rod bundle. After making three turns (in the case illustrated here) around the bundle the head of the wire meets a stop not shown in the drawing. The wire is then cut off close to the inlet opening 5 and its ends knotted. It should also be noted that it may be considered surprising that it is possible for a stiff wire of this type to be advanced continuously from behind its guided head and for such a long distance as three times the circumference of the annular structure.

Details of the apparatus, and in particular a cutting and knotting device which is not shown, are known in the art and need not be given (reference is made to EP-A-74985 and GB-A-1001385).

There are now three turns around the bundle, two without and one with a knot. One of the top parts of the annular structure 1 carries a pin 7 extending axially within the circle made by the turns of wire pushed along the channel 6. The axial location of the pin 7 is such that it is within two of the turns of wire, but not within the third turn which includes the knotted ends of the wire. The lower part of the annular structure 1 carries a restraining bar 8 extending across it above the bundle of rods. When the annular structure 1 is now opened as shown in FIG. 5, the pin 7 inserted on the top of the bundle between two of the turns and the bundle is moved upwards away from the bundle while the bundle is unable to move any further than the bar 8 permits. This movement pulls the wire and results in formation of two lifting loops, which are suitable as a lifting point for the bundle, in the two wire turns so pulled by the pin 7. At the same time the third turn is tightened around the bundle.

The channel 6 is formed by a combination with side wall elements 9 which are attached by suitable means of attachment to the annular base of the structure 1, as shown in FIG. 7. A turn of the channel 6 lies between each adjacent pair of the elements 9.

What is claimed is:

1. An apparatus for binding articles by means of stiff wire, comprising at least a two turn helical channel annular guide means comprising separable arcuate sections for guiding said wire around at least one article which is to be bound by at least two turns;

pulling means insertable within at least one of said turns for forming at least one lifting loop in the form of a portion of said wire spaced from said at least one article by pulling at least one of said turns away from said at least one article and restraining means for holding back said at least one article when said pulling means acts on said wire.

2. An apparatus according to claim 1 including means for feeding said wire into said helical channel.

3. An apparatus according to claim 2 wherein said helical channel is formed by channel side wall parts attached to arcuate sections forming said annular guide means.

4. An apparatus according to claim 1 wherein said helical channel has three turns for forming three turns around said at least one article.

5. An apparatus for binding articles by means of stiff wire, comprising at least a two turn helical channel annular guide means comprising separable arcuate sections for guiding said wire around at least one article which is to be bound by at least two turns;

pulling means insertable within at least one of said turns for forming at least one lifting loop in the form of a portion of said wire spaced from said at least one article by pulling at least one of said turns away from said at least one article, one of said arcuate sections of said separable annular guide mounting said pulling means and means to separate, said separable arcuate sections thereby effecting the pulling of at least one of said turns of said wire by said pulling means to form at least one said lifting loop.

* * * * *